US005542181A

United States Patent [19]

Gaylord

[11] Patent Number: 5,542,181

[45] Date of Patent: Aug. 6, 1996

[54] INTERIOR CUTTING EDGE FORK UTENSIL

[76] Inventor: Caroline J. Gaylord, 1600 Cobblestone Ct., Chesterton, Ind. 46304

[21] Appl. No.: 509,496

[22] Filed: Jul. 31, 1995

[51] Int. Cl.[6] ..... A47J 43/28

[52] U.S. Cl. ..... 30/148; 30/322

[58] Field of Search ..... 30/137, 148, 322; D7/653

[56] References Cited

U.S. PATENT DOCUMENTS 399,109 3/1889 Wynkoop ..... 30/148

1,553,006 9/1925 Sallac ..... 30/148

2,322,503 6/1943 Bowman ..... 30/148

*Primary Examiner*—Hwel-Siu Payer

[57] ABSTRACT

A utensil for cutting an impaling food objects. The inventive device includes an elongated handle having a plurality of tines projecting therefrom. Lateral cutting edges extend along interior edges of the tines for engaging and cutting a food object such that a severed portion thereof can be engaged by the tines for manual manipulation by the handle.

3 Claims, 2 Drawing Sheets

INTERIOR CUTTING EDGE FORK UTENSIL

BACKGROUND OF THE INVENTION

1. Field of the Invention

The present invention relates to utensil structures and more particularly pertains to an interior cutting edge fork utensil for cutting and impaling food objects.

2. Description of the Prior Art

The use of utensil structures is known in the prior art. More specifically, utensil structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art utensil structures include U.S. Pat. No. 4,984,367; U.S. Pat. No. 4,896,423; U.S. Pat. No. 4,771,541; U.S. Pat. No. 5,175,933; U.S. Pat. No. 5,119,563; and U.S. Pat. No. 3,609,865.

While these devices fulfill their respective, particular objectives and requirements, the aforementioned patents do not disclose an interior cutting edge fork utensil for cutting and impaling food objects which includes an elongated handle having a plurality of tines projecting therefrom, with lateral cutting edges extending along interior edges of the tines for engaging and cutting a food object such that a severed portion thereof can be engaged by the tines for manual manipulation by the handle.

In these respects, the interior cutting edge fork utensil according to the present invention substantially departs from the conventional concepts and designs of the prior art, and in so doing provides an apparatus primarily developed for the purpose of cutting and impaling food objects.

SUMMARY OF THE INVENTION

In view of the foregoing disadvantages inherent in the known types of utensil structures now present in the prior art, the present invention provides a new interior cutting edge fork utensil construction wherein the same can be utilized for cutting and impaling food objects. As such, the general purpose of the present invention, which will be described subsequently in greater detail, is to provide a new interior cutting edge fork utensil apparatus and method which has many of the advantages of the utensil structures mentioned heretofore and many novel features that result in a interior cutting edge fork utensil which is not anticipated, rendered obvious, suggested, or even implied by any of the prior art utensil structures, either alone or in any combination thereof.

To attain this, the present invention generally comprises a utensil for cutting an impaling food objects. The inventive device includes an elongated handle having a plurality of tines projecting therefrom. Lateral cutting edges extend along interior edges of the tines for engaging and cutting a food object such that a severed penion thereof can be engaged by the tines for manual manipulation by the handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new interior cutting edge fork utensil apparatus and method which has many of the advantages of the utensil structures mentioned heretofore and many novel features that result in a interior cutting edge fork utensil which is not anticipated, rendered obvious, suggested, or even implied by any of the prior art tool guides, either alone or in any combination thereof.

It is another object of the present invention to provide a new interior cutting edge fork utensil which may be easily and efficiently manufactured and marketed.

It is a further object of the present invention to provide a new interior cutting edge fork utensil which is of a durable and reliable construction.

An even further object of the present invention is to provide a new interior cutting edge fork utensil which is susceptible of a low cost of manufacture with regard to both materials and labor, and which accordingly is then susceptible of low prices of sale to the consuming public, thereby making such interior cutting edge fork utensils economically available to the buying public.

Still yet another object of the present invention is to provide a new interior cutting edge fork utensil which provides in the apparatuses and methods of the prior art some of the advantages thereof, while simultaneously overcoming some of the disadvantages normally associated therewith.

Still another object of the present invention is to provide a new interior cutting edge fork utensil for cutting and impaling food objects.

Yet another object of the present invention is to provide a new interior cutting edge fork utensil which includes an elongated handle having a plurality of tines projecting therefrom, with lateral cutting edges extending along interior edges of the tines for engaging and cutting a food object such that a severed portion thereof can be engaged by the tines for manual manipulation by the handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
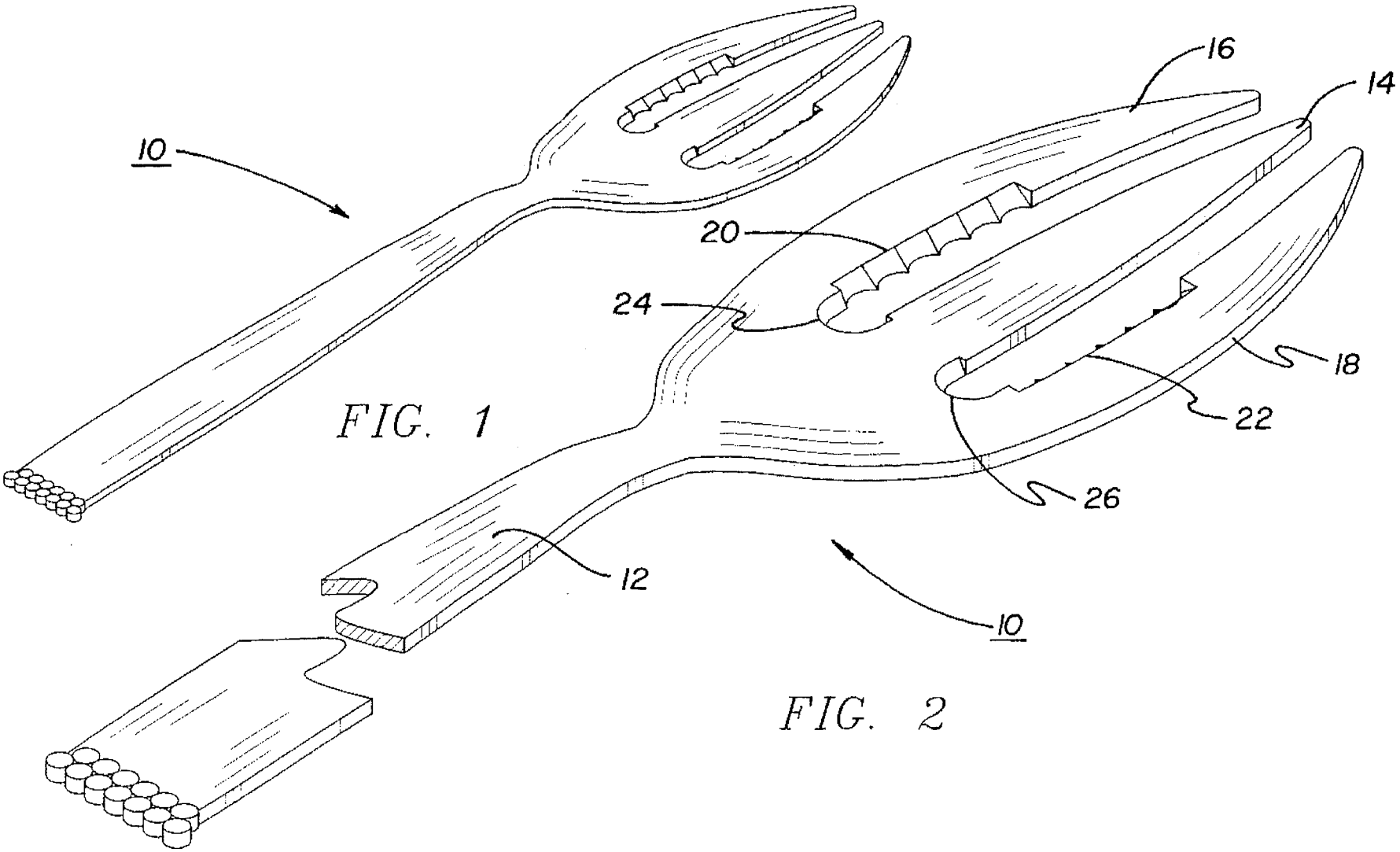
FIG. 1 is an isometric illustration of an interior cutting edge fork utensil according to the present invention.
FIG. 2 is an enlarged isometric illustration thereof.

With reference now to the drawings, and in particular to FIGS. 1–4 thereof, a new interior cutting edge fork utensil embodying the principles and concepts of the present invention and generally designated by the reference numeral 10 will be described.

More specifically, it will be noted that the interior cutting edge fork utensil 10 comprises an elongated handle 12 for being grasped and manipulated by an individual during use of the device 10. A center line 14 projects from a first end of the handle 12 and is oriented so as to extend substantially collinearly therefrom. A first lateral line 16 extends from the first end of the handle 12 along a first lateral side of the center line 14, with a second lateral line 18 extending from the first end of the handle 12 and along a second lateral side of the center line 14. The lateral tines 16 and 18 are spaced from the center line 14 so as to define an unlabeled slot directed therebetween substantially as shown in FIGS. 1 and 2 of the drawings. A first lateral cutting edge 20 is formed along an interior edge of the first lateral line 16, with a second lateral cutting edge 22 similarly extending along an interior edge of the second lateral line 1.8. The lateral cutting edges 20 and 22 face the center line 14 and preferably extend along only a portion of the interior edge of the respective lateral line 16 and 18. By this structure, a food object such as a seafood shell can be cut through engagement of the lateral cutting edges 20 or 22 therewith, whereby the tines 14–18 can be subsequently utilized to facilitate elevation of the severed portion of food to a desired position for consumption thereof.

With continuing reference to FIGS. 1 through 4, it can be shown that the present invention 10 may further be shaped so as to define a first U-shaped cutting edge 24 extending between the interior edge of the first lateral line 16 and a first interior edge of the center line 14. Similarly, a second U-shaped cutting edge 26 can extend between the interior edge of the second lateral line 18 and a second interior edge of the center line 14. The U-shaped cutting edges 24 and 26 can be individually utilized to effect continued cutting of a food object such as a seafood shell or the like.

Figure 3:
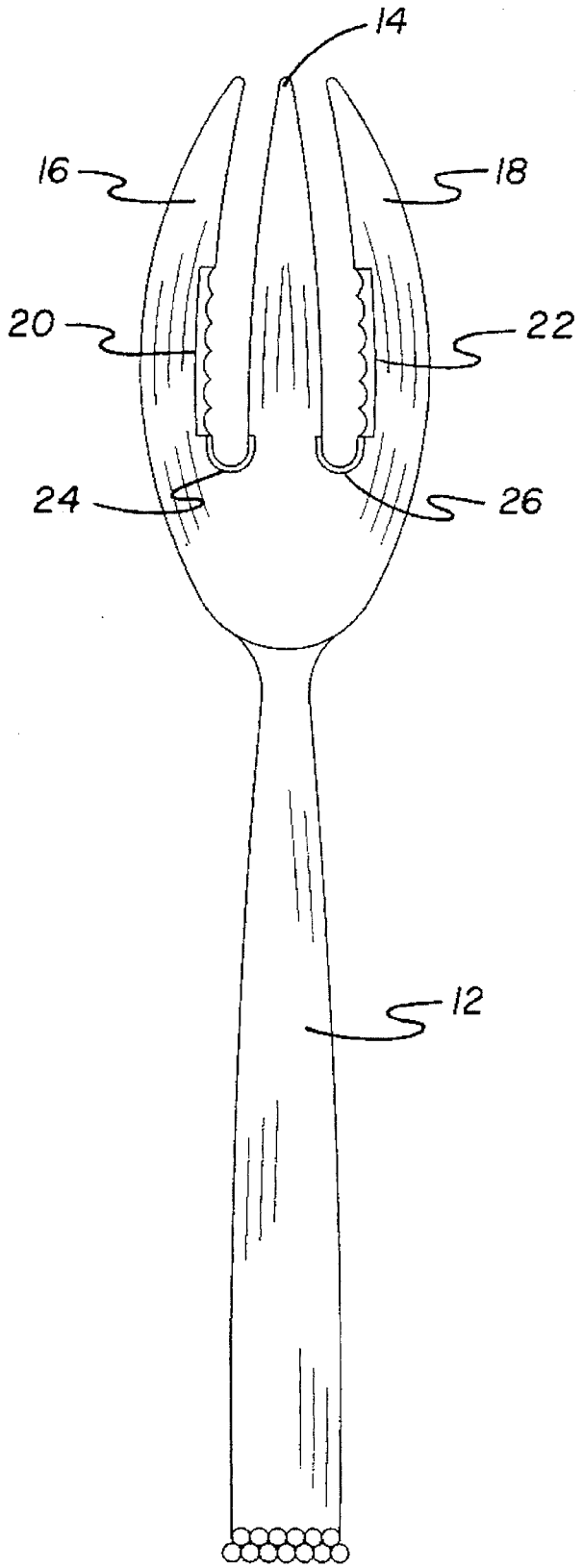
FIG. 3 is a top plan view of the invention.
Figure 4:
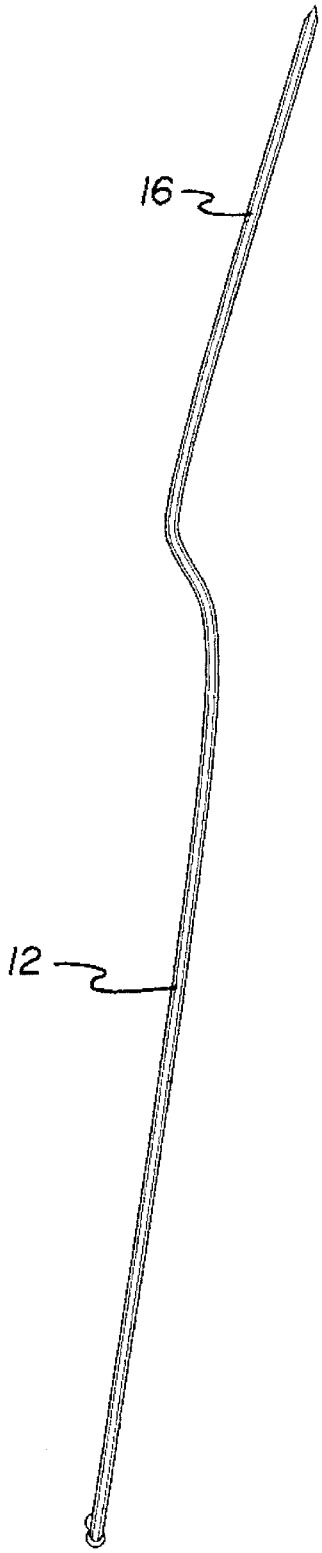
FIG. 4 is a side elevation thereof.

As best illustrated in FIG. 3, it can be shown that the lateral cutting edges 20 and 22 are preferably formed as serrated cutting edges having a plurality of sharpened indentations for facilitating ease of cutting of associated objects. As shown in FIG. 4, the tines 14–18 are preferably off-set from the handle 12 so as to reside in a plane spaced from a plane containing the handle.

In use, the interior cutting edge fork utensil 10 according to the present invention can be easily utilized for cutting and impaling food objects during an eating procedure. The configuration of the present invention including the specific positioning of the cutting edges 20–26 allows for an individual to utilize a single utensil for both cutting and feeding, whereby unintentional cutting of interior surfaces of the mouth is substantially precluded by the shielded positioning of the cutting edges 20–26.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An interior cutting edge fork utensil comprising:

an elongated handle for being grasped and manipulated by an individual, the handle having a center tine, first lateral tine and a second lateral tine, each tine projecting from a first end of the handle, the center tine being oriented so as to extend substantially collinearly form the handle, the first lateral tine extending from the handle along a first lateral side of the center tine, the second lateral tine extending from the handle along a second lateral side of the center tine, the first and second lateral tines being spaced from the center tine so as to define slots directed therebetween;

a first lateral cutting edge extending along an interior edge of the first lateral tine;

a second lateral cutting edge extending along an interior edge of the second lateral tine, the first lateral cutting edge and the second lateral cutting edge each face the center tine; and a first U-shaped cutting edge extending between the interior edge of the first lateral tine and a first interior edge of the center tine, and a second U-shaped cutting edge extending between the interior edge of the second lateral tine and a second interior edge of the center tine.

2. The interior cutting edge fork utensil of claim 1, wherein the lateral cutting edges are formed as serrated cutting edges having a plurality of sharpened indentations.

3. The interior cutting edge fork utensil of claim 2, wherein the tines are off-set from the handle so as to reside in a plane spaced from a plane containing the handle.

* * * * *